US005408819A

United States Patent [19]

Nishimura et al.

[11] Patent Number: 5,408,819

[45] Date of Patent: Apr. 25, 1995

[54] METAL CORD FOR REINFORCING RUBBER ARTICLE

[75] Inventors: Yoshifumi Nishimura; Kenichi Okamoto, both of Itami, Japan

[73] Assignee: Sumitomo Electric Industries, Inc., Osaka, Japan

[21] Appl. No.: 948,610

[22] Filed: Sep. 22, 1992

Related U.S. Application Data

[63] Continuation of Ser. No. 700,460, May 15, 1991, abandoned.

[30] Foreign Application Priority Data

May 15, 1990 [JP] Japan ..... 2-125766
Mar. 20, 1991 [JP] Japan ..... 3-056897

[51] Int. Cl.[6] ..... D07B 1/12

[52] U.S. Cl. ..... 57/206; 57/236; 57/311; 57/902

[58] Field of Search ..... 57/200, 206, 236, 241, 57/242, 258, 311, 902

[56] References Cited

U.S. PATENT DOCUMENTS 4,333,306 6/1982 Yamashita et al. ..... 57/902 X
4,509,318 4/1985 Yoneda ..... 57/902 X
4,718,470 1/1988 Kusakabe et al. ..... 57/902 X

FOREIGN PATENT DOCUMENTS 55-90692 7/1980 Japan .
58-31438 7/1983 Japan .
58-48392 11/1983 Japan .
62-125084 6/1987 Japan .
62-170594 7/1987 Japan .
62-282923 12/1987 Japan .
63-42985 2/1988 Japan .
250482 10/1989 Japan ..... 57/902

*Primary Examiner*—Hail, III: Joseph J.
*Attorney, Agent, or Firm*—Wenderoth, Lind & Ponack

[57] ABSTRACT

A metal cord for reinforcing a rubber article is made by twisting three or more metal filaments. At least one or at most the total number minus two of the metal filaments have a larger shaping ratio in the diametrical direction of the cord than the other metal filaments. At least one of the metal filaments having a larger shaping ratio is kept out of contact at portions in the longitudinal direction with a metal filament or filaments arranged in juxtaposition at one side or both sides thereof. At least two adjacent ones of the metal filaments having a smaller shaping ratio are in contact with each other.

7 Claims, 3 Drawing Sheets

METAL CORD FOR REINFORCING RUBBER ARTICLE

This application is a continuation of application Ser. No. 07/700,460, filed on May 15, 1991, now abandoned.

BACKGROUND OF THE INVENTION

1. Field of the Invention

This invention relates to a metal cord for reinforcing a rubber article such as a vehicle tire, a conveyor belt or a high-pressure hose, and more particularly a metal cord which is effective in improving the durability of such rubber articles.

2. State of the Prior Art

A metal cord for reinforcing a rubber article is usually made of high carbon steel wires containing 0.65–0.85% of carbon (JIS G 3502 piano wire rods) having their surface plated with such metals as brass, copper or zinc in order to impart adhesion with rubber. Such wires are drawn to a diameter of 0.1 to 0.4 mm and twisted together.

The quality characteristics required for a metal cord for reinforcing a vehicle radial tire includes adhesion with rubber, bonding durability, resistance to corrosion and various mechanical properties (such as breaking load, rigidity, fatigue properties and flexibility). Among them, the resistance to corrosion is greatly influenced by the penetration of rubber into the cord.

Among the metal cords having a single twisting structure, closed cords (C.C.) having 1×5, 1×4 and 1×3 structures are widely used. But as shown in FIG. 5, which show such cords in section, they have a hollow space in the center. If such a cord is used for reinforcing a rubber article, rubber cannot penetrate into the hollow space. Since rubber penetration into the cord is poor, if the tire should hit a stone or a nail and sustain a cut so deep as to reach the metal cord, water will penetrate into the cord, developing corrosion from inside the cord. This will lower the breaking load and the resistance to fatigue. Also, the bonding strength between the cord and the rubber will decrease, causing peeling and thus separation of the tire. This will cause the trouble with quality.

In order to improve rubber penetration, an open cord (O.C.) as shown in FIG. 6 was proposed in Unexamined Japanese Patent Publication 55-90692 in which metal filaments 1 are twisted together with spaces formed therebetween. Further, in Examined Japanese Patent Publication 58-31438, a cord as shown in FIG. 7 was proposed having a cross-section which is not uniform in the longitudinal direction (hereinafter referred to as 2+2 cord).

Various other cords are known, which will be described later.

The aforementioned open cord and the 2+2 twisting structure were proposed in order to improve rubber penetration into the cord. But since the open cord is liable to become stretched under low tensile load, when tension is applied to such cords during the calendering step in the production of a tire, they will become stretched and their metal filaments will be drawn close to one another. This may reduce the size of the spaces between the filaments, thus causing insufficient rubber penetration. Also, these cords have a problem in that when the cord is compressed under pressure during the vulcanizing step after forming a tire, the spaces between the filaments tend to be reduced, making the penetration of rubber difficult. Further, in producing such open cords, it is extremely difficult to obtain a cord having a uniform twisting structure in the longitudinal direction, since the twisting is loose. Thus, the spaces between the metal filaments may vary. Also, the metal filaments may be distributed not uniformly, but partially to one side with respect to the diametric direction of the cord as viewed in section. This will cause individual cords to be stretched unevenly due to tension loads when pulling the cords for proper arrangement during the calendering step. Thus, the distances between the cords tend to be uneven.

On the other hand, the 2+2 cord permits good rubber penetration. But this cord has a problem in that its cross-sectional shape is not circular but rugged at parts in the longitudinal direction. The distances between cords tend to fluctuate and become uneven when they pass through guide rollers during the calendering step. Further, the resistance to fatigue is bad.

SUMMARY OF THE INVENTION

It is an object of this invention to provide a metal cord for reinforcing a rubber article which is free of the abovementioned problems during the calendering step and which has improved rubber penetration without impairing the resistance of fatigue and which can improve the durability of the rubber article.

In accordance with the present invention, there is provided a metal cord for reinforcing a rubber article made by twisting three or more metal filaments, wherein at least one or at most the total number minus two of the metal filaments have a larger shaping ratio or degrees of shaping (i.e. the filaments have a larger spiralling tendency due to preshaping), causing tendency to bulge in the diametrical direction of the cord, than the other metal filaments. At least one of the metal filaments having a larger shaping ratio is kept out of contact at portions in longitudinal direction with a metal Filament or filaments arranged in juxtaposition at one side or both sides thereof. At least two adjacent ones of the metal filaments having a smaller shaping ratio are in contact with each other.

At some parts in the longitudinal direction the cord may have a structure as mentioned above, whereas at the remaining parts in the longitudinal direction the cord may have a twisting structure in which all the metal filaments have the same shaping ratio and the adjacent metal filaments are in contact with one another, the two parts having different twisting structures being arranged alternately.

As a solution to the problems of the open cord proposed in Unexamined Japanese Patent Publication 55-90692, Examined Japanese Utility Model Publication 58-48392 proposed a cord in which the metal filaments are so arranged that they have their parts alternately kept out of contact with and in contact with the adjacent filaments. Unexamined Japanese Patent Publications 62-125084 and 63-42985 proposed a cord in which the metal filaments have parts where they are kept out of contact with one another and parts where some of the filaments are out of contact with one another whereas others are in contact with one another so that the non-contact parts and the partial contact parts are arranged alternately. Since these cords have parts where the filaments are out of contact with one another due to loose twisting, these parts tend to stretch more easily under tensile load during calendering step. Such uneven stretching will make the drawing of the cord uneven or make it difficult for rubber to penetrate into the cord.

Unexamined Japanese Patent Publications 62-170594 and 62-282923 proposed a cord made by twisting metal filaments in separate groups having different shaping ratios so that even if the cord stretches so that the filaments are drawn close to each other, the metal filaments having a high shaping ratio serve to maintain spaces. But these publications mention nothing about the fact that among the metal filaments having a smaller shaping ratio at least two adjacent ones are in contact with one another. Thus, even though the problem of poor rubber penetration is obviated with this cord, there is left a problem that it tends to stretch unevenly when subjected to tension during the calendering step, thus making it difficult to pull it evenly.

The metal cord according to the present invention is free of all these problems.

In connection with the metal cord according to the present invention, description will be made, taking cords including one metal filament having a large shaping ratio as an example. More specifically, FIGS. 1*a* to 1*c* show cords having a 1×3 twisting structure, FIGS. 2*a* to 2*c* show cords having a 1×4 twisting structure and FIGS. 3*a* to 3*c* show cords having a 1×5 twisting structure. As shown in FIGS. 1*a*, 2*a* and 3*a*, a metal filament 1-1 is kept out of contact with filaments 1-2 and 1-3 or as shown in FIGS. 1*b*, 1*c*, 2*b*, 2*c*, 3*b* and 3*c*, the filament 1-1 is in contact at one side only with one of the filaments 1-2 or 1-3 (the filaments may be arranged so that the sectional shapes shown in a), b) and c) may appear one after another in the longitudinal direction of the cord). With this arrangement, since a space is formed in the sectional area of the metal cord at least at one part thereof, rubber penetration improves.

The shaping ratio of the metal filament 1-1 is sufficient to form a space which permits penetration of rubber, preferably a space about 0.2 mm or more. If the shaping ratio is too large, uneven twisting would result. Also, too large shaping ratio is not advantageous in maintaining the quality of the cord during the calendering step or from the viewpoint of resistance to fatigue because the cross-sectional shape of the cord tends to be rugged as viewed in the longitudinal direction. Thus, the upper limit of the shaping ratio should be determined taking into account the manufacturing conditions during the twisting and calendering steps. On the other hand, the other metal filaments having a smaller shaping ratio should have a shaping ratio small enough to keep them in contact with each other in order to reduce the amount of stretch under low tension and thus to prevent quality problems during the calendering step. The filaments are judged to be in contact with each other if they appear to be in contact when viewed through a magnifying glass of approximately ten magnifications.

The object of the present invention is attained by increasing the shaping ratio of two adjacent metal filaments (e.g. 1-1 and 1-2) in case of the 1×4 twisting structure, or by increasing the shaping ratio of two adjacent metal filaments (e.g. 1-1 and 1-2 or 1-1 and 1-3) or three adjacent metal filaments (e.g. 1-1, 1-2 and in case of the 1×5 twisting structure. In this case, the shaping ratios of the respective metal filaments do not have to be equal to one another. But the plurality of metal filaments having larger shaping ratios should be selected so that at least two adjacent ones of the metal filaments having smaller shaping ratios will be in contact with each other and kept in this state.

Although metal cords which achieve the object of the present invention can be obtained by increasing the shaping ratio of a plurality of metal filaments, in order to minimize fluctuations in elongation when subjected to tension during the calendering step and to attain uniform twisting when manufacturing the cord, the number of metal filaments having a large shaping ratio should be as small as possible. From the viewpoint of ease of manufacture, only one of the metal filaments should have a large shaping ratio to form a space which permits easy penetration of rubber.

The metal cord according to the present invention may include parts having the above-described twisting structure, i.e. the one in which a space for penetration of rubber is formed at least at one part in the cross-sectional surface of the metal cord and parts having a twisting structure in which the adjacent filaments having approximately the same shaping ratios are arranged in contact with each other, these parts being arranged alternately in the longitudinal direction of the cord. Such a metal cord can be pulled uniformly during the calendering step because the tightly twisted adjacent filaments are in contact with each other at some parts and thus they are less likely to be elongated when tension is applied. Rubber can penetrate into the portions where the Filaments are tightly twisted and thus all the filaments are in contact with one another, through the adjacent portions formed with spaces, by the pressure during the vulcanizing step. But if the contact portions are too long, rubber cannot penetrate sufficiently. Thus their length should be determined suitably depending on the level of the pressure.

According to the present invention, the twisting pitch of the metal filaments should be equal within the range of 5–20 mm. If the twisting pitch is less than 5 mm, the productivity will decrease. If larger than 20 mm, the cord might get loose at its ends when it is cut or its flexibility would decrease. Practically, the twisting pitch should be set at 8–16 mm. Also, the diameter of the metal filaments should be 0.1–0.4 mm. More than two kinds of metal filaments having different diameters may be twisted together.

According to the present invention, unlike a conventional open cord in which all the metal filaments have a large shaping ratio in the diametrical direction, only one or up to (n−2) metal filaments have a large shaping ratio in order to provide spaces barely enough to allow penetration of rubber, while at least two adjacent ones of the other metal filaments are kept in contact with each other. Thus the cord is prevented from being greatly elongated under low tensile load. This prevents the metal filaments having a large shaping ratio from being drawn to each other during the calendering step and thus the spaces from being closed off. Further, the distances between the cords can be kept uniform while they are pulled for arrangement. According to the present invention, rubber penetration can be improved without causing undue influence on other properties required for the metal cord for reinforcing a rubber article. This will greatly improve the durability of the rubber article.

BRIEF DESCRIPTION OF THE DRAWINGS

Other features and objects of the present invention are described below with reference to the accompanying drawings, in which.

DETAILED DESCRIPTION OF THE PREFERRED EMBODIMENT

[Embodiment 1]

Figure 1A:
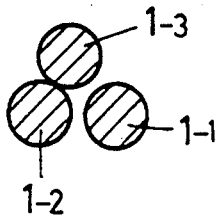
FIGS. 1a–1c are sectional views of embodiments having a 1×3 twisting structure.
Figure 1B:
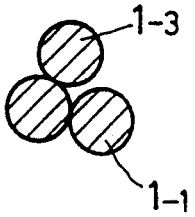
Figure 1C:
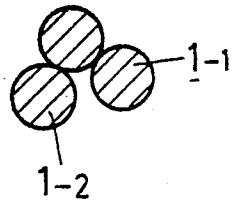

Three brass-plated metal filaments having a diameter of 0.30 mm were twisted together at a twisting pitch of 15 mm with two of the three not shaped and the remaining one shaped. 1×3×0.30 semi-open cords (S.O.C.) having sectional shapes as shown in FIGS. 1a–1c were obtained.

[Embodiment 2]

Figure 2A:
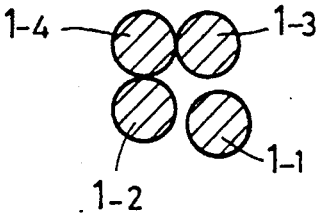
FIGS. 2a–2c are sectional views of embodiments having a 1×4 twisting structure.
Figure 2B:
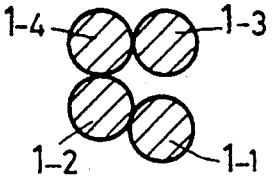
Figure 2C:
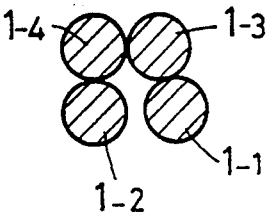

Four brass-plated metal filaments having a diameter of 0.28 mm were twisted together at a twisting pitch of 15 mm with three of the four not shaped but the remaining one shaped to obtain 1×4×0.28 semi-open cords having sectional shapes as shown in FIGS. 2a–2c.

[Embodiment 3]

Figure 3A:
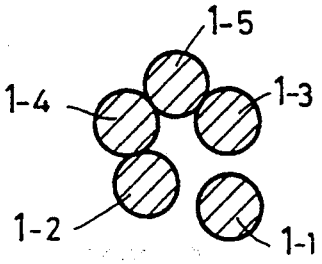
FIGS. 3a–3c are sectional views of embodiments having a 1×5 twisting structure (with one of the metal filaments having a larger shaping ratio)
Figure 3B:
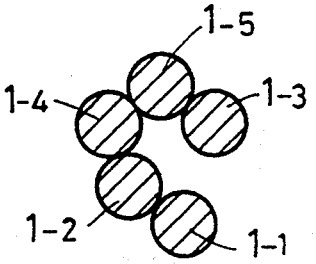
Figure 3C:
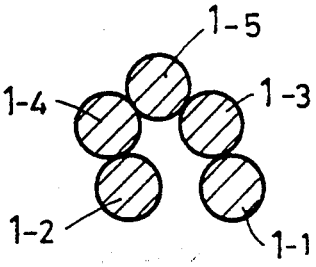
Figure 4A:
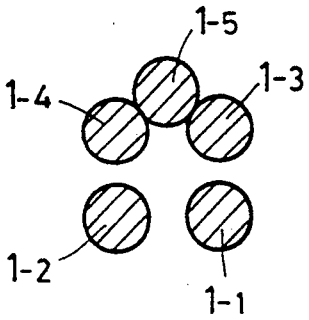
FIGS. 4a–4g are sectional views of embodiments having a 1×5 twisting structure (with two metal filaments having a larger shaping ratio)
Figure 4B:
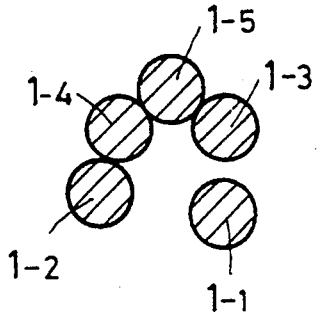
Figure 4C:
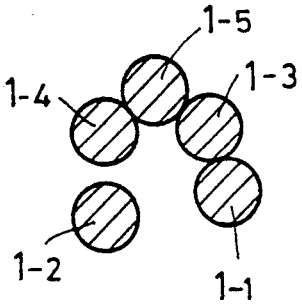
Figure 4D:
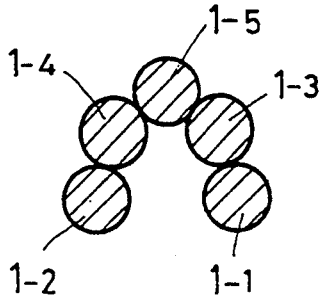
Figure 4E:
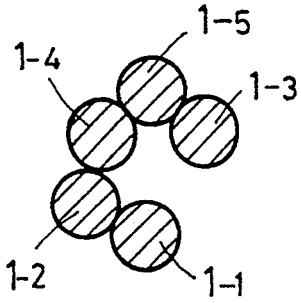
Figure 4F:
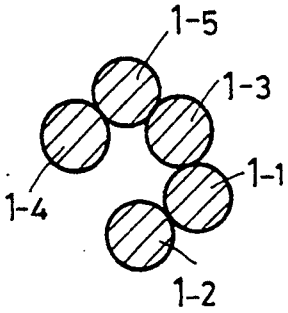
Figure 4G:
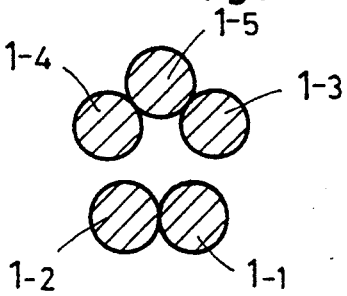

Five brass-plated metal filaments having a diameter of 0.25 mm were twisted together at a twisting pitch of 15 mm with four of the five not shaped but the remaining one shaped to obtain 1×5×0.25 semi-open cords having sectional shapes as shown in FIGS. 3a–3c.

[Embodiment 4]

Five brass-plated metal filaments having a diameter of 0.25 mm were twisted together at a twisting pitch of 15 mm with three of the five not shaped but the remaining two shaped to obtain 1×5×0.25 semi-open cords having sectional shapes as shown in FIGS. 4a–4g.

[Embodiment 5]

Figure 5A:
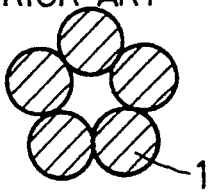
FIG. 5(a) PRIOR ART
FIGS. 5a–5c are sectional views of various closed cords according to the prior art.
Figure 5B:
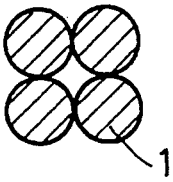
FIG. 5(b) PRIOR ART
Figure 5C:
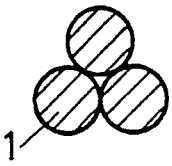
FIG. 5(c) PRIOR ART
Figure 6:
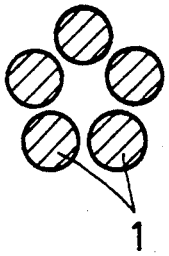
FIG. 6 PRIOR ART
FIG. 6 is a sectional view of a 1×5 open cord in the prior art.
Figure 7:
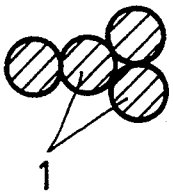
FIG. 7 PRIOR ART
FIG. 7 is a sectional view of a 2+2 cord.

Five brass-plated filaments having a diameter of 0.25 mm were prepared. Three of them were not shaped at all while the remaining two were given shaped and non-shaped portions alternately by cyclically operating a shaping device to obtain a cord having alternate portions having a 1×5×0.25 S.O.C structure as shown in FIG. 4 and portions having the structure of a 1×5×0.25 closed cord (C.C.) as shown in FIG. 5a.

Also, for comparative purposes, a conventional closed cord (C.C.) and an open cord (O.C.) having a structure as shown in Table 1 were prepared. Their twisting pitch was 15 mm. These specimen cords were tested for rubber penetration, which is a substitute property of corrosion resistance, and elongation in a low-load region (load level of 0–2 kg). The results are shown in Table 1. As is apparent from this table, the embodiments 1–5 showed good rubber penetration and small stretch in a low-load region compared with the comparative cords.

TABLE 1

| | Size and twisting structure | Rubber penetration (%)*1 | Elongation at low load area (%)*2 |
|---|---|---|---|
| Comparative example (1) | 1 × 5 × 0.25 C · C | 0 | 0.09 |
| Comparative example (2) | 1 × 5 × 0.25 0 · C | 90 | 0.81 |
| Comparative example (3) | 1 × 4 × 0.28 C · C | 0 | 0.09 |
| Comparative example (4) | 1 × 3 × 0.30 C · C | 0 | 0.10 |
| Embodiment (1) | 1 × 3 × 0.30 S · 0 · C | 90 | 0.12 |
| Embodiment (2) | 1 × 4 × 0.28 S · 0 · C | 80 | 0.10 |
| Embodiment (3) | 1 × 5 × 0.25 S · 0 · C | 60 | 0.11 |
| Embodiment (4) | 1 × 5 × 0.25 S · 0 · C | 80 | 0.13 |
| Embodiment (5) | 1 × 5 × 0.25 S · 0 · C + C · C | 60 | 0.12 |

*1 After embedded in rubber and vulcanized, the length of part where rubber has penetrated into the cord was measured. The ratio of the length to the entire cord length.

*2 Elongation under tensile test with a tensile load of 0–2 kg.

What is claimed is:

1. A single-layer metal cord for reinforcing a rubber article, comprising:

at least three and at most five metal filaments twisted together in a single layer cord structure of one of a 1×3, 1×4, and 1×5 twisting structure;

wherein at least one said metal filament, and at most all of said metal filaments minus two, are preshaped to have a larger spiralling tendency and thus a greater tendency to bulge than the other said metal filaments;

wherein at least one of said preshaped metal filaments having a larger spiralling tendency, having other said metal filaments juxtaposed at two sides thereof, is kept out of contact with one or more of said metal filaments at said sides at portions of said metal filaments in the longitudinal direction thereof; and wherein at least two adjacent said metal filaments of the other said metal filaments, which are not preshaped and thus have a smaller spiralling tendency than said preshaped metal filaments, are in contact with each other.

2. The metal cord of claim 1, wherein said preshaped metal filaments are preshaped along their entire longitudinal extent.

3. The metal cord of claim 2, wherein said metal filaments have a diameter of 0.1–0.4 mm and are twisted together at the same twisting pitch within a range of 5–20 mm.

4. The metal cord of claim 1, wherein said at least one said metal filament and at most all of said metal filaments minus two are preshaped to have a larger spiralling tendency only at first portions in the longitudinal direction thereof, which alternate with second portions thereof having the same spiralling tendency as the other said metal filaments, adjacent said metal filaments of all of said metal filaments being in contact with one another at said second portions.

5. The metal cord of claim 4, wherein said metal filaments have a diameter of 0.1–0.4 mm and are twisted together at the same twisting pitch within a range of 5–20 mm.

6. The metal cord of claim 1, wherein said metal filaments have a diameter of 0.1–0.4 mm and are twisted together at the same twisting pitch within a range of 5–20 mm.

7. The metal cord of claim 6, wherein the twisting pitch is within a range of 8–16 mm.

* * * * *